United States Patent [19]

Meiller

[11] 4,217,907

[45] Aug. 19, 1980

[54] ORTHOPEDIC SHOE CONSTRUCTION

[76] Inventor: Theodore J. Meiller, 1308 Bennett, Bryan, Tex. 77801

[21] Appl. No.: 933,592

[22] Filed: Aug. 14, 1978

[51] Int. Cl.[2] ..... A43B 7/24

[52] U.S. Cl. ..... 128/583

[58] Field of Search ..... 128/583, 584, 585, 581, 128/80 R

[56] References Cited

U.S. PATENT DOCUMENTS

| | | | |
|---|---|---|---|
| 3,463,165 | 8/1969 | Goodman | 128/583 |
| 3,532,098 | 10/1970 | Rodenberger | 128/583 |
| 3,731,323 | 5/1973 | Glancy | 128/583 |
| 3,929,139 | 12/1975 | Salzman | 128/583 |

*Primary Examiner*—John D. Yasko

*Attorney, Agent, or Firm*—Richards, Harris & Medlock

[57] ABSTRACT

Certain foot deformities may be corrected by attaching an orthopedic appliance (16) to the heel (12) of a shoe (10) to establish a moment in the shoe to cause rotation thereof in response to ground engagement of the appliance under the weight of the shoe wearer. The orthopedic appliance (16), for attachment to the bottom of the shoe, has a two sided relatively flat base (18) with one side (18*a*) attached to the shoe and the second side (18*b*) provided with an arrangement of a plurality of projecting ribs (22). Each projecting rib (22) is formed at an acute angle with respect to the second side (18*b*) of the base, and each projection has an undercut reduced cross-sectional area (28) in a direction of flexure at the attachment to the base. Encircling the projecting ribs is a stabilizing ring (20) that limits the compression of the projecting ribs (22) between the second side (18*b*) and the ground engagement and provides a fixed supporting surface. At the center of the projecting ribs (22) there is attached to the second side (18*b*) of the base a wear pad (24) for further limiting the compression of the projecting ribs.

6 Claims, 3 Drawing Figures

ORTHOPEDIC SHOE CONSTRUCTION

TECHNICAL FIELD

This invention relates to an orthopedic shoe appliance, and more specifically to an orthopedic shoe appliance for attachment to the heel of a shoe to correct certain foot deformities.

BACKGROUND ART

Foot deformities, such as "toe in" or "toe out", are generally corrected in infancy and childhood by having the child wear a special shoe with a foot clamp fastened to the shoe so as to force a turning of the child's foot. Usually, such shoes are worn by the child during rest periods, such as during sleeping hours, and due to the turning action provided over an extended period of time the child's bones tend to return to a normal straightened position. Another commonly used technique for correcting the type of foot deformities mentioned is to have wedges placed on the shoe in a manner to roll the ankle in an attempt to rotate to the foot. These shoes are generally worn by the child during the active times of the day, such as when walking or running.

Heretofore, a number of orthopedic shoe appliances have been developed to provide more effective and gentle correction of foot deformities. Examples of such elements are found in U.S. Pat. No. 3,470,879 to T. J. Meiller and U.S. Pat. No. 3,532,098 to Charles A. Rodenburger. In the first mentioned U.S. patent, the shoe element, either a heel or sole, or both, is provided with a plurality of resilient, parallel, spaced ribs arranged at an acute angle with respect to the longitudinal axis of the element and canted towards one end of the axis. In the latter mentioned patent, the element, usually attached to the heel of the shoe, has a plurality of resilient projections extending from one side and disposed in pairs, one on each of the opposite sides of a central point of the element. The projections are formed at an acute angle with respect to the supporting side with the projections on one side of the central point being slanted in a direction opposite to the direction of those on the other side of the central point.

DISCLOSURE OF THE INVENTION

In accordance with the present invention, an orthopedic appliance for attachment to the bottom side of a shoe includes an arrangement of projecting ribs for establishing a moment in the shoe to cause rotation thereof in response to ground engagement under weight of the shoe wearer. Surrounding the projecting ribs is a stabilizing ring that provides a solid heeling to the wearer and provides increased stability as the projecting ribs are compressed by ground engagement. Further in accordance with the present invention the projecting ribs are undercut at the base to control the collapsing weight.

In accordance with the present invention, an orthopedic appliance has a two sided base, with one side adapted for securing to the bottom side of a shoe, and includes an arrangement of projecting ribs extending from the second side of the base. A stabilizer surrounds the projecting ribs to provide a solid heel and limit the compression of the ribs against the second surface and ground engagement.

A more complete understanding of the invention and its advantages will become apparent from the following description taken in conjunction with the included claims.

BRIEF DESCRIPTION OF THE DRAWINGS

Referring to the drawings.

DETAILED DESCRIPTION

Figure 1:
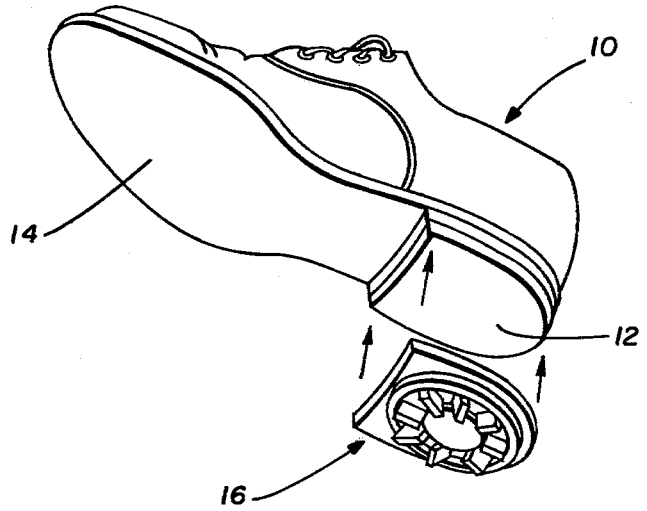
FIG. 1 is an exploded perspective view of the orthopedic appliance of the present invention for attachment to the heel area of a shoe.

Referring to FIG. 1, a shoe 10 of conventional construction is illustrated as having a heel area 12 and sole 14. The heel 12 may be modified or of conventional construction to receive an orthopedic appliance 16. It will be understood, however, that the attachment of the orthopedic appliance 16 to the heel 12 will be tailored to provide a desired corrective action to the wearer of the shoe 10.

Figure 2:
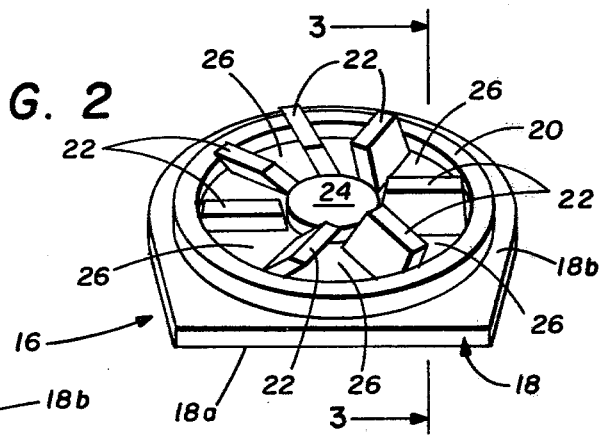
FIG. 2 is a perspective view of the orthopedic appliance showing the arrangement of projecting ribs and surrounding stabilizing ring.

Referring to FIGS. 1 and 2, the orthopedic appliance 16 includes a relatively flat base 18 having a first surface **18*a* for attachment to the heel area 12. The upper surface 18*b* of the base 18 supports a stabilizing ring 20 including an arrangement of projecting ribs 22, seven illustrated. At the center of the projecting ribs 22 there is located a wear pad 24**.

When attached to the heel area 12 of the shoe 10 the orthopedic appliance will provide a desired corrective action as will be explained. The appliance is of a one piece molded construction and is made of resilient material such as rubber, or a rubber like synthetic material. In a preferred embodiment of the invention the orthopedic appliance 16 was manufactured by an injection molding technique using a polyurethane material.

As illustrated, the projecting ribs 22 are arranged in a circular configuration and extend at an acute angle with respect to the upper surface **18*b* of the base 18. The angle that each of the ribs makes with the base 18 is selectable up to slightly less than 90° and in one model of the orthopedic appliance 16** the angle is approximately 60°. This angle is selected when designing the appliance for manufacture in accordance with the degree of correction necessary.

While the number of projecting ribs is not fixed the open space between any two of the ribs must be greater than the height of any one so that when weight is applied to the heel area the canted or slanted ribs will flex and fold into adjacent open space 26. Accordingly, when the weight of the shoe wearer is applied to the heel 12, the projecting ribs 22 will fold into adjacent open space 26. This folding of the ribs in the circular configuration illustrated in FIGS. 1 and 2 establishes a rotating moment in the base 18 that is transferred to the attached shoe 10 to cause rotation thereof in response to ground engagement of the ribs 22 under the weight of the shoe wearer. The direction of the rotational moment depends on the particular direction of the slant of the projecting ribs 22 with respect to the longitudinal axis of the shoe 10 to which the heel is attached. The degree of angular shifting is determined by the height, spacing and angle of slant of the projecting ribs 22.

With the projecting ribs 22 at the angle of slant illustrated in FIGS. 1 and 2 the orthopedic appliance when attached to the right heel of a shoe will correct for a "toe in" abnormal foot condition. To correct for a "toe out" abnormal foot condition the angle of slant of the projecting ribs 22 would be opposite that of the illustration of FIGS. 1 and 2. Thus, the projecting ribs 22 all slant in either a clockwise or counterclockwise direction and are disposed on a radial line extending from the center of the heel. Since opposed ribs 22 are at opposite ends of a diameter through the heel the ribs will slant in opposite directions, such as more clearly illustrated in FIG. 2, and contact of the ribs with the ground surface will produce the desired rotational moment resulting in rotation of the heel and shoe to which it is attached.

When in use, the ground engaging surfaces of the projecting ribs 22 will all move in either a clockwise or counterclockwise direction, depending on the angle of slant with respect to the base 18, when a vertical force is applied to the heel 12, as for example, when the shoe wearer applies pressure on the heel by walking. The direction of slant and the degree of slant determines whether the correction will be for a "toe in" or "toe out" condition, and the amount of correction effected by use of the appliance 16. Note, that there is no critical sequence in which the projecting ribs 22 must contact the ground surface.

Figure 3:
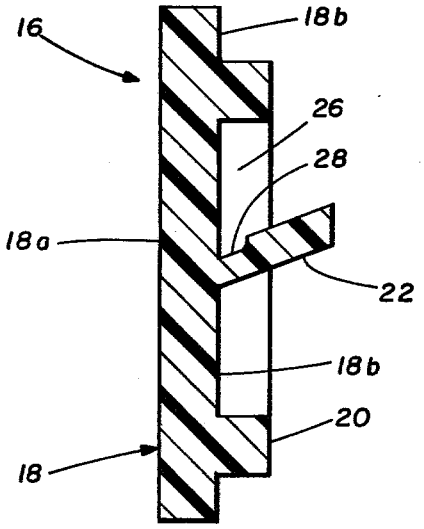
FIG. 3 is a cross-sectional view taken through the line 3—3 of FIG. 2.

Referring to FIG. 3, the amount of vertical force applied to the heel 12 to cause angular deflection of the projecting rib 22 is partially determined by means of an undercut 28. The undercut is located at the juncture of the projecting rib 22 and the upper surface **18*b* of the base 18. The depth of the undercut will determine the amount of vertical force required to cause a flexure of the rib 22. A minimum or no undercut will support and provide corrective action for a wearer of greater weight than when the undercut 28 is as illustrated in FIG. 3**.

Referring to FIGS. 1–3, encircling the arrangement of projecting ribs 22 is the stabilizing ring 20 attached to or formed as an integral part of the base 18. The depth of the projecting ring 20 in the direction extending from the surface **18*b* is approximately equal to or slightly greater than the cross-sectional dimension of a projecting rib 22. When no further rotational motion can be imparted to the heel area 12 by flexure of the projecting ribs 22, the stabilizing ring 20 will be in ground engagement thereby limiting the compression of the projecting ribs between the base surface 18*b* and ground. The stabilizing ring 20 now supports all the weight placed on the heel 12 thereby protecting the ribs from abrasion and excessive wear. The stabilizing ring 20** provides a solid heel feel and imparts stability to a walking motion.

To further protect the projecting ribs 22 from abrasion and excessive wear, the wear pad 24 is located at the center of the arrangement of projecting ribs 22. The height of the wear pad 24 above the base surface **18*b* is approximately the same as the height of the stabilizing ring 20. Again this is equal to or slightly greater than the cross-sectional dimension of a projecting rib 22**.

To utilize the orthopedic appliance of the present invention, the approximate weight of the wearer of the shoe 10 should be known and the amount of correction required should be evaluated. These two factors will determine the selection of a particular appliance configuration having a given undercut 28 and a given angle between the upper surface **18*b* and the rib 22. With these factors known, plus the abnormal foot condition to be corrected, the particular appliance is attached to the heel area 12. The shoe 10 can be worn in a manner similar to a shoe of conventional construction. With each walking step where the heel engages the ground a rotational moment will be imparted to the shoe in the direction of slant of the ribs. Thus, the direction of slant of the ribs will determine whether "toe in" or "toe out" is corrected. With the ribs 22 slanting in a counterclockwise direction, as shown in the figures, the heel will cause a shoe to rotate in a counterclockwise direction. As the flexure of the projecting ribs 22 is completed thereby providing maximum rotation to the shoe 10, the stabilizing ring 20 and the wear pad 24** become effective to protect the ribs. In addition, the stabilizing ring provides a feel to the wearer of the shoe similar to that received by conventional shoe construction.

While only one embodiment of the invention, together with modifications thereof, has been described in detail herein and shown in the accompanying drawings, it will be apparent that various further modifications are possible without departing from the scope of the invention.

I claim:

1. An orthopedic appliance having a two sided base, with one side adapted for securing to the bottom of a shoe, comprising in combination:

an arrangement of a plurality of projecting ribs extending from the second side of said base to establish a moment in said base and an attached shoe to cause rotation thereof in response to ground engagement of said projections under an applied weight, and stabilizing means surrounding the projecting ribs to limit the compression thereof between the second side of the base and ground engagement and to provide a fixed supporting surface.

2. An orthopedic appliance as set forth in claim 1 wherein the projecting ribs are arranged in a circular configuration and said stabilizing means comprises a projecting ring attached to the second side of the base and encircling the ribs.

3. An orthopedic appliance as set forth in claim 1 wherein all ribs flex in the same direction and each includes an undercut cross-sectional area in the direction of the flexure and at the attachment thereof to the base.

4. An orthopedic appliance as set forth in claim 1 including a wear pad attached to the base at the center of the arrangement of said projecting ribs and extending from the base a distance at least equal to the cross-sectional dimension of a projecting rib.

5. An orthopedic appliance having a two sided base, with one side adapted for securing to the bottom side of a shoe, comprising in combination:

a plurality of projecting ribs arranged in a circular configuration extending from the second side of the base to establish a moment in the base and an attached shoe to cause rotation thereof in response to ground engagement of the shoe under an applied weight, a projecting ring encircling said plurality of projecting ribs and attached to the second side to limit the compression of the projecting ribs between the second surface and the ground engagement and to provide a fixed supporting surface, and a wear pad attached to the base at the center of said projecting ribs and extending from the base a distance at least equal to the cross-sectional dimension of a projecting rib.

6. An orthopedic appliance as set forth in claim 5 wherein all ribs flex in a given direction and each includes an undercut cross-sectional area in the direction of flexure at the attachment thereof to the base.

* * * * *